US006375394B1

(12) United States Patent
Vesterlund

(10) Patent No.: US 6,375,394 B1
(45) Date of Patent: Apr. 23, 2002

(54) METHOD OF DRILLING HOLES IN A DRYER CYLINDER

(75) Inventor: Ingmar Vesterlund, Phyajoki (FI)

(73) Assignee: Pikoteknik Oy, Parhalahti (FI)

( * ) Notice: Subject to any disclaimer, the term of this patent is extended or adjusted under 35 U.S.C. 154(b) by 0 days.

(21) Appl. No.: 09/582,389

(22) PCT Filed: Dec. 29, 1998

(86) PCT No.: PCT/FI98/01028

§ 371 Date: Jun. 26, 2000

§ 102(e) Date: Jun. 26, 2000

(87) PCT Pub. No.: WO99/33599

PCT Pub. Date: Jul. 8, 1999

(30) Foreign Application Priority Data

Dec. 29, 1997 (FI) ..... 974633

(51) Int. Cl.[7] ..... B23B 35/00
(52) U.S. Cl. ..... 408/1 R; 408/53
(58) Field of Search ..... 408/1 R, 53, 80, 408/82, 201; 409/143

(56) References Cited

U.S. PATENT DOCUMENTS

| | | | | | |
|---|---|---|---|---|---|
| 1,854,053 | A | | 4/1932 | Millspaugh | |
| 3,028,772 | A | * | 4/1962 | Mossberg | 408/201 |
| 3,696,504 | A | * | 10/1972 | Cupler, II | 408/1 R |
| 4,425,059 | A | * | 1/1984 | Colas et al. | 408/1 R |
| 4,674,925 | A | * | 6/1987 | Thornton et al. | 408/1 R |
| 4,968,189 | A | * | 11/1990 | Pidgeon | 408/1 R |
| 5,090,846 | A | | 2/1992 | Hakala et al. | 408/1 R |
| 5,344,259 | A | | 9/1994 | Rajala et al. | 408/46 |

FOREIGN PATENT DOCUMENTS

WO 9846386 10/1998

* cited by examiner

*Primary Examiner*—Daniel W. Howell
(74) *Attorney, Agent, or Firm*—Volpe and Koenig, P.C.

(57) ABSTRACT

The invention relates to a method of drilling holes to the surface of a dryer cylinder in a paper machine. The main goal of the method is to open and or/widen the drilled holes already made on the dryer cylinder, thus improving the performance of the cylinder.

3 Claims, 1 Drawing Sheet

METHOD OF DRILLING HOLES IN A DRYER CYLINDER

The present invention relates to a method of drilling holes to the surface of a dryer cylinder in a paper machine, said dryer cylinder comprising a shell, a cavity enclosed by the shell and grooves made to the outer surface of the shell.

Today, it is conventional to provide the outer surfaces of dryer cylinders in a paper machine with grooves running circumferentially along the perimeter of the cylinder. These grooves in turn are provided with drilled holes serving to improve air flow through the web and simultaneously to aid the adherence of the web to the cylinder surface during the rotation of the cylinder. Such drilled holes are patterned so as to perforate the shell at the groove bottoms down into the hollow interior of the cylinder.

This arrangement, however, is hampered by the relatively small diameter of the holes drilled on the cylinder shell, typically about 4 mm. Due to the small size, the holes will gradually become plugged by the particulate matter separating from the web, whereby the function of the dryer cylinder is substantially degraded.

A remedy to the above-mentioned problem has been sought from a drilling pattern with a substantially high excess number of holes, whereby some plugging of the holes still leaves a major portion of the holes free to pass the air flow. Even this approach may involve the problem of regional plugging of all holes. Then, the web will be subjected to an uneven air flow causing bagginess in the web that is easily torn at the bags. On the other hand, the excess number of holes must be limited to avoid too large an air flow into the cylinder interior, thus causing an essential degradation of the dryer cylinder efficiency.

It is an object of the present invention to overcome the disadvantages of the above-described prior-art techniques and to provide an entirely novel arrangement permitting the shell of a dryer cylinder to be drilled in a reliable manner to assure a sufficient flow rate of air.

The goal of the invention is attained by virtue of the method specifications defined in appended claims. More precisely, the method according to the invention is principally characterized by what is stated in the characterizing part of claim 1.

In practice, the method according to the invention is implemented by restoring the air flow properties of a dryer cylinder in a paper machine through a redrilling operation adapted to open the holes on the cylinder shell.

The drilling technique according to the invention offers a cylinder reconditioning method that is capable of restoring the condition of the cylinder and even improving its function over the original performance, with a further benefit of being applicable onsite at the actual location of the cylinder. By virtue of enlarging the diameter of the original holes drilled on the cylinder shell through redrilling the holes into a slightly larger size, the rapid plugging of cylinder shell holes can be prevented without excessively increasing the air flow rate through the cylinder shell.

By drilling the holes from the cylinder interior outward, it is possible to avoid the formation of disturbing hole burrs that are conventionally raised during drilling on the outer surface of the cylinder shell.

It must be noted that the present method according to the invention can be used for both opening and widening the original cylinder shell holes that are plugged or expected to become plugged soon as well as for perforating the cylinder shell with entirely new holes.

In the following, the invention will be examined in greater detail with the help of the appended drawings, in which FIG. 1 shows a detail of the cross section of a dryer cylinder after long use;

Figure 1:
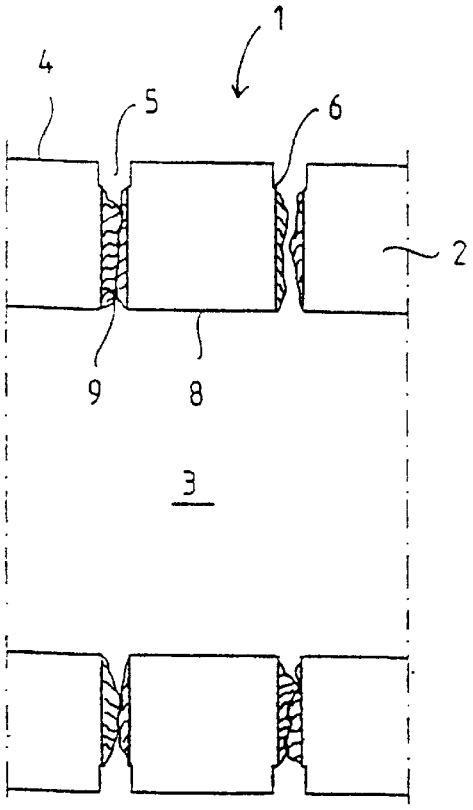

Referring to FIGS. 1–4, therein is shown a preferred basic implementation of the drilling method according to the invention. In the diagrams, FIG. 1 shows a shell 2 of a dryer cylinder 1 of a paper machine after prolonged use. The shell encloses a cylindrical cavity 3 which depending on the cylinder type may or may not house a shaft (not shown). The method according to the invention concerns a dryer cylinder type having the outer surface 4 of the shell contoured with a groove 5, whereby the shell is penetrated at the groove bottom 6 with hole 7 extending downward up to the inner surface 8 of the shell thus providing a passageway between the groove and the hollow interior of the cylinder. As is illustrated in the diagram, at this stage of cylinder use, the holes have already accumulated a substantial amount of particulate matter 9 which typically causes a smaller or greater degree of plugging of the holes 7.

Figure 2:
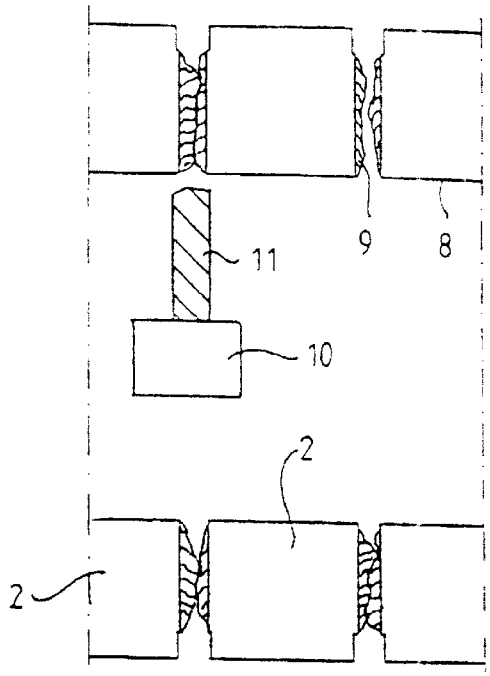
FIG. 2 shows a drilling apparatus approaching the shell inner surface in the interior of a dryer cylinder.

In FIG. 2 is shown the cavity 3 of the dryer cylinder 1 with drilling equipment 10 introduced therein, whereby the equipment can be a conventional drill apparatus known in the art and adapted for this type of work, or more advantageously, a drilling apparatus purpose-designed for this operation is used. In its simplest embodiment, such a drilling apparatus can be a conventionally powered hand drill.

The drilling apparatus 10 comprises at least one spindle 11 which is directed in the interior of the cylinder shell 2 toward the inner surface thereof, with the center of the drill bit aligned essentially at the center of the original hole 7 drilled in the shell. The drilling apparatus may during the drilling operation be supported, e.g., against the opposite side of the dryer cylinder interior. Alternatively, if the cylinder is provided with a full-length shaft, the drilling apparatus may have a design adapted movable along said shaft. The drilling apparatus may also have a ring-shaped frame resting on the inner surface 8 of the cylinder shell, whereby the drill spindle(s) is/are movable along a circular path into any desired position on the inner surface of the cylinder shell.

Figure 3:
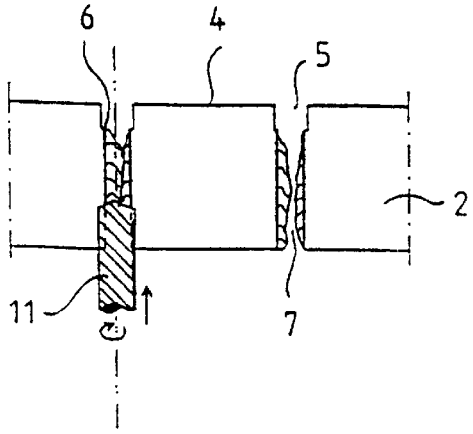
FIG. 3 shows the drilling of the dryer cylinder shell.

Next, in FIG. 3 is shown a drilling apparatus 10 utilizing the method according to invention for reconditioning a plugged hole 7 on the shell 2 of a dryer cylinder 1, simultaneously widening the diameter of the hole and thus improving the performance of the cylinder.

Figure 4:
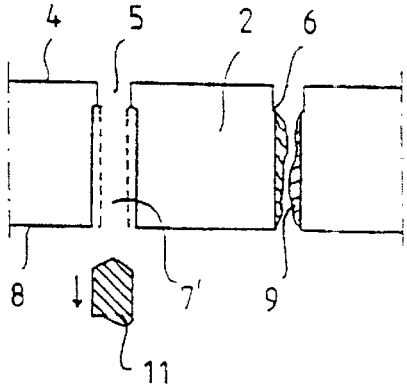
FIG. 4 shows the withdrawal of the drill bit from the reconditioned hole.

Finally, in FIG. 4 is shown a cross-sectional detail of the hole 7 drilled on the shell 2 of the dryer cylinder 1 when the drilling operation has proceeded, starting from the inner surface of the shell, as deep as to the bottom 6 of the groove 5. In the diagram, the original hole of the shell is denoted by a dashed line, whereby it is easy to see that the method according to the invention produces a reconditioned hole 7' with a diameter larger than of the original hole. Advantageously, the diameter of the new hole 7' is made larger than the width of the groove made on the outer surface 4 of the shell. Such a hole advantageously having a diameter of 6–8 mm assures that the particulate matter detached from the web cannot accumulate on the hole thus plugging it.

A benefit of the above-described drilling technique performed radially outward from the interior of the cylinder as described above is that the formation of undesirable drill burrs on the exterior of the cylinder shell is avoided.

The main goal of the method according to the invention is to open and/or widen the drilled holes 7 already made on the dryer cylinder 1 of a paper machine, thus improving the performance of the cylinder. However, the method according to the invention may also be employed in the above-described fashion for making an entirely new drilling pattern 7, 7' on the dryer cylinder 1. Also herein, the method makes it possible to avoid the formation of undesirable drilling burrs on the outer surface 4 of the cylinder shell 2 thus reducing the amount of cylinder surface finishing work after drilling.

To those versed in the art it is obvious that the exemplifying embodiments and the drawings related thereto serve only to elucidate the concept of the invention. Hence, the invention is not limited by the application described above or defined in the appended claims, but rather, it is obvious to a person versed in the art that a plurality of different variations and modifications may be contemplated within the scope and inventive spirit of the appended claims.

What is claimed is:

1. Method for drilling holes to the surface of a dryer cylinder (1) in a paper machine, said dryer cylinder comprising a shell (2), a cavity (3) enclosed by the shell and grooves (5) made to the outer surface (4) of the shell, characterized in that into the interior cavity (3) of the dryer cylinder (1) is introduced a drilling apparatus (10), said apparatus comprising at least one drill spindle (11) which is directed essentially perpendicularly toward the inner surface (8) of the shell (2), that subsequently said at least one drill spindle is aligned into a desired position at a groove (5) made to the outer surface (4) of the cylinder shell, at which point the drill bit of the spindle is controlled to penetrate the shell of said dryer cylinder (1), whereby the drill bit cuts in the shell a hole (7, 7') that extends radially outward reaching essentially from the inner surface (8) of the cylinder shell to the bottom (6) of the groove made to the outer surface of the cylinder shell.

2. Method according to claim 1, characterized in that, when controlling the drill spindle (11) to meet the shell (2) of the dryer cylinder (1), the center of the drill bit is aligned essentially at the center of the hole (7) which is already drilled extending from the bottom (6) of said groove (5) to the inner surface (8) of the shell, whereby the drill bit penetrating the shell simultaneously opens said original hole (7) made to said shell.

3. Method according to claim 2, characterized in that, as said drill bit (11) opens said hole (7) already made to said shell, it simultaneously widens the diameter of the hole thus making a hole (7') of a larger diameter.

* * * * *